US011320213B2

(12) United States Patent
Wilson et al.

(10) Patent No.: US 11,320,213 B2
(45) Date of Patent: May 3, 2022

(54) FURNACE CONTROL SYSTEMS AND METHODS

(71) Applicant: Johnson Controls Technology Company, Auburn Hills, MI (US)

(72) Inventors: Stephen C. Wilson, Oklahoma City, OK (US); Kerry L. Shumway, Norman, OK (US); William M. Harris, Norman, OK (US); Randy R. Koivisto, Noble, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 271 days.

(21) Appl. No.: 16/530,337

(22) Filed: Aug. 2, 2019

(65) Prior Publication Data

US 2020/0348087 A1 Nov. 5, 2020

Related U.S. Application Data

(60) Provisional application No. 62/841,654, filed on May 1, 2019.

(51) Int. Cl.

| | |
|---|---|
| ***F28F 1/10*** | (2006.01) |
| ***F24H 9/20*** | (2006.01) |
| ***F24F 11/84*** | (2018.01) |
| ***F24F 11/755*** | (2018.01) |
| ***F24F 11/74*** | (2018.01) |

(Continued)

(52) U.S. Cl.

CPC ..... *F28F 1/10* (2013.01); *F24F 11/30* (2018.01); *F24F 11/70* (2018.01); *F24F 11/72* (2018.01); *F24F 11/74* (2018.01); *F24F 11/75* (2018.01); *F24F 11/755* (2018.01); *F24F 11/80* (2018.01); *F24F 11/84* (2018.01); *F24H 9/2085* (2013.01)

(58) Field of Classification Search

CPC .. F24F 11/72; F24F 11/70; F24F 11/30; F24F 11/84; F24F 11/80; F24F 11/775; F24F 11/74; F24F 11/75; F24F 9/2085; F24F 11/755; F24H 9/2085

See application file for complete search history.

(56) References Cited

U.S. PATENT DOCUMENTS 2,039,910 A * 5/1936 Kriechbaum ..... H01Q 1/08 237/2 R 3,315,655 A 4/1967 Stone et al.

(Continued)

OTHER PUBLICATIONS

BPM Motors in Residential Gas Furnaces What Are the Savings—Lutz et al. (2006) (Year: 2006).*

*Primary Examiner* — Len Tran
*Assistant Examiner* — Jenna M Hopkins
(74) *Attorney, Agent, or Firm* — Fletcher Yoder, P.C.

(57) ABSTRACT

A furnace of a heating, ventilation, and/or air conditioning (HVAC) system includes a heat exchange tube configured to receive a working fluid from a burner and a modulating valve fluidly coupled to the burner. The modulating valve is configured to regulate an amount of fuel supplied to the burner to generate the working fluid. The furnace also includes a blower configured to draw the working fluid through the heat exchange tube, a motor drive configured to adjust a speed of the blower, and a controller configured to adjust a position of the modulating valve and to control the motor drive to adjust the speed of the blower based on a temperature of air discharged from the HVAC system.

27 Claims, 7 Drawing Sheets

(51) Int. Cl.

| | |
|---|---|
| ***F24F 11/70*** | (2018.01) |
| ***F24F 11/30*** | (2018.01) |
| ***F24F 11/80*** | (2018.01) |
| ***F24F 11/72*** | (2018.01) |
| ***F24F 11/75*** | (2018.01) |

(56) References Cited

U.S. PATENT DOCUMENTS 4,337,893 A 7/1982 Flanders et al.
4,457,291 A 7/1984 Henke
4,688,547 A * 8/1987 Ballard ..... F23N 1/022 126/116 A
4,915,615 A * 4/1990 Kawamura ..... B60H 1/2206 431/41
5,307,990 A * 5/1994 Adams ..... F24H 9/2085 236/11
5,470,018 A 11/1995 Smith
5,513,979 A 5/1996 Pallek et al.
5,732,691 A 3/1998 Maiello et al.
5,819,721 A * 10/1998 Carr ..... F24H 9/2085 126/116 A
5,860,411 A 1/1999 Thompson et al.
5,865,611 A * 2/1999 Maiello ..... F23N 5/022 431/12
5,878,741 A 3/1999 Dempsey et al.
6,070,660 A 6/2000 Byrnes et al.
6,109,255 A 8/2000 Dieckmann et al.
6,250,133 B1 6/2001 Schell
6,283,115 B1 9/2001 Dempsey et al.
6,321,744 B1 11/2001 Dempsey et al.
6,684,944 B1 2/2004 Byrnes et al.
6,695,046 B1 2/2004 Byrnes et al.
6,705,342 B2 3/2004 Santinanavat et al.
6,705,533 B2 3/2004 Casey et al.
6,749,423 B2 6/2004 Fredricks et al.
6,758,208 B2 * 7/2004 Gierula ..... F24H 3/087 126/110 R
6,786,225 B1 9/2004 Stark et al.
6,866,202 B2 * 3/2005 Sigafus ..... F23N 5/203 236/11
6,918,756 B2 7/2005 Fredricks et al.
7,101,172 B2 * 9/2006 Jaeschke ..... F23N 3/08 431/19
7,191,826 B2 3/2007 Byrnes et al.
7,293,718 B2 11/2007 Sigafus et al.
7,523,762 B2 4/2009 Buezis et al.
7,735,743 B2 6/2010 Jaeschke
7,802,984 B2 * 9/2010 Specht ..... F23N 1/025 431/89
7,850,448 B2 12/2010 Slaby
8,070,481 B2 12/2011 Chian et al.
8,123,518 B2 * 2/2012 Nordberg ..... F23N 5/203 431/12
8,188,698 B2 5/2012 Rollins et al.
8,206,147 B2 * 6/2012 Videto ..... F23D 23/00 431/12
8,261,733 B2 9/2012 Hugghins
8,515,584 B2 8/2013 Miller et al.
8,560,127 B2 * 10/2013 Leen ..... G05D 19/02 700/278
8,591,221 B2 11/2013 Schultz
8,629,640 B2 1/2014 Rollins et al.
8,635,997 B2 1/2014 Schultz et al.
8,672,670 B2 * 3/2014 Hugghins ..... F23N 5/242 431/2
8,726,539 B2 5/2014 Potter et al.
8,752,577 B2 6/2014 Santinanavat et al.
8,764,435 B2 7/2014 Nordberg et al.
8,876,524 B2 * 11/2014 Schultz ..... F23N 3/082 431/12
8,925,541 B2 * 1/2015 Thompson ..... F23N 1/102 126/99 R
8,965,586 B2 2/2015 Miller et al.
9,032,950 B2 * 5/2015 Schultz ..... F23N 5/203 126/110 C
9,038,658 B2 5/2015 Santinanavat et al.
9,043,034 B2 5/2015 Miller et al.
9,200,847 B2 12/2015 Thompson
9,228,758 B2 1/2016 Hugghins
9,234,661 B2 * 1/2016 Young ..... F23N 1/022
9,261,277 B2 2/2016 Hugghins et al.
9,291,355 B2 3/2016 Hugghins
9,316,413 B2 4/2016 Nordberg et al.
9,317,046 B2 4/2016 Gum
9,528,712 B2 * 12/2016 Caruso ..... F24D 5/08
9,625,177 B2 * 4/2017 Hrejsa ..... F24D 19/1084
10,295,211 B2 * 5/2019 Perez ..... F24D 19/1084
10,422,531 B2 * 9/2019 Super ..... F23N 5/003
10,502,454 B2 * 12/2019 Wilson ..... F28F 1/42
10,782,033 B2 * 9/2020 Perez ..... F23D 91/02
2002/0092516 A1 7/2002 Gierula et al.
2002/0155405 A1 * 10/2002 Casey ..... F23N 1/002 431/60
2003/0198908 A1 10/2003 Berthold et al.
2006/0105279 A1 * 5/2006 Munsterhuis ..... F23N 5/123 431/18
2008/0124667 A1 5/2008 Schultz
2013/0108971 A1 * 5/2013 Maiello ..... G05D 27/02 431/12
2013/0220301 A1 8/2013 Saksena et al.
2014/0061322 A1 3/2014 Hrejsa et al.
2014/0117904 A1 5/2014 Rollins et al.
2015/0128926 A1 5/2015 Noman et al.
2015/0219355 A1 8/2015 Miller et al.
2017/0211822 A1 7/2017 Perez et al.

* cited by examiner

FURNACE CONTROL SYSTEMS AND METHODS

CROSS-REFERENCE TO RELATED APPLICATIONS

This application claims priority from and the benefit of U.S. Provisional Application Ser. No. 62/841,654, entitled "FURNACE CONTROL SYSTEMS AND METHODS," filed May 1, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a building, home, or other structure. Conventional HVAC systems often include a furnace system that may be used to heat an air flow supplied to an air distribution system of the building. For example, typical furnace systems may include a burner assembly and a heat exchanger that cooperate to produce hot air, which may be directed through the air distribution system to heat a room or other space within the building. Generally, furnace systems operate by burning or combusting a mixture of air and fuel in the burner assembly to produce combustion products that are directed through tubes or piping of the heat exchanger. An air flow passing over the tubes or piping extracts heat from the combustion products, thereby enabling the exportation of heated air from the furnace system. Unfortunately, conventional furnace systems may be unable to efficiently control production of the combustion productions, thereby rendering the furnace systems inadequate to efficiently control a temperature of the heated air discharged by the furnace systems.

SUMMARY

The present disclosure relates to a furnace of a heating, ventilation, and/or air conditioning (HVAC) system that includes a heat exchange tube configured to receive a working fluid from a burner and a modulating valve fluidly coupled to the burner. The modulating valve is configured to regulate an amount of fuel supplied to the burner to generate the working fluid. The furnace also includes a blower configured to draw the working fluid through the heat exchange tube, a motor drive configured to adjust a speed of the blower, and a controller configured to adjust a position of the modulating valve and to control the motor drive to adjust the speed of the blower based on a temperature of air discharged from the HVAC system.

The present disclosure also relates to a furnace of a heating, ventilation, and/or air conditioning (HVAC) system that includes a heat exchange tube configured to receive a working fluid from a burner and a modulating valve fluidly coupled to the burner and configured to regulate an amount of fuel supplied to the burner to generate the working fluid. The furnace system includes a blower configured to draw the working fluid through the heat exchange tube and a motor drive configured to adjust a speed of the blower. The furnace further includes a controller configured to adjust a position of the modulating valve and to control the motor drive to adjust the speed of the blower with a rate-of-change control scheme selected from a plurality of rate-of-change control schemes based on a measured parameter of air discharged from the HVAC system.

The present disclosure also relates to a furnace of a heating, ventilation, and/or air conditioning (HVAC) system that includes a modulating valve configured to control a fuel flow to a burner, where the burner is configured to combust the fuel flow to generate a working fluid and to discharge the working fluid into a heat exchange tube. The furnace also includes a blower configured to draw the working fluid through the heat exchange tube and a motor drive configured to adjust a speed of the blower. The furnace further includes a controller configured to incrementally adjust the modulating valve and to control the motor drive to incrementally adjust the speed of the blower with a rate-of-change control scheme selected from a plurality of rate-of-change control schemes based on a measured parameter of air discharged from the HVAC system.

DETAILED DESCRIPTION

Figure 1:
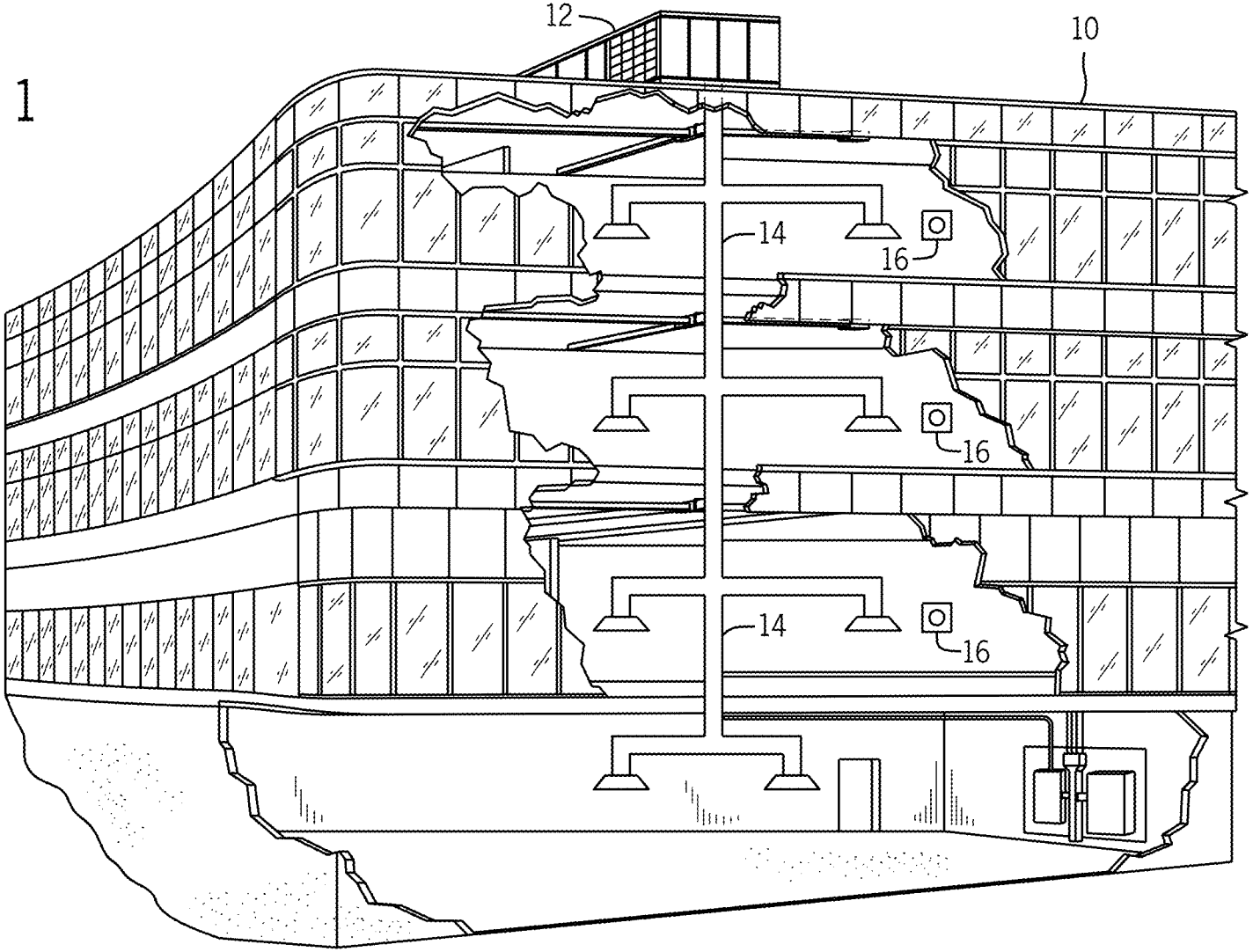
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, HVAC systems may include a furnace system that enables the HVAC systems to supply heated air to rooms or zones within a building or other suitable structure. Typical furnace systems include one or more burner assemblies and a heat exchanger that cooperate to produce the heated air. For example, furnace systems generally operate by burning or combusting a mixture of air and fuel in the burner assemblies to produce hot combustion products that are directed through tubes or piping of the heat exchanger. A blower may direct an air flow across the tubes or piping of the heat exchanger, thereby enabling the air to absorb thermal energy from the combustion products. In this manner, heated air may be discharged from the furnace system and directed to the rooms or zones of the building. That is, the blower may direct the heated air through an air distribution system of the building, such as through a system of ductwork and/or suitable conduits, and thus supply the heated air to rooms or zones of the building calling for heating. Accordingly, the furnace system may ensure that a heating demand of the building is adequately met.

Unfortunately, conventional furnace systems are often unable to efficiently regulate production of the combustion products in response to deviations in a heating demand of the building and/or in response to deviations in an air flow rate across the tubes or piping of the heat exchanger. As such, conventional furnace systems may often overheat or not sufficiently heat, relative to a target temperature setpoint, the air discharged by the furnace system. Indeed, due to the limited adjustability in combustion product production of typical furnace systems, the furnace systems may be ill-suited for application in variable air volume (VAV) HVAC systems which, in many cases, significantly vary the air flow rate across the heat exchanger of the furnace systems based on a heating demand of the building.

It is now recognized that more efficiently regulating the production of combustion products enables fine-tuned adjustment of a heat output rate of the furnace system, such as in response to deviations in operational parameters of the HVAC system. In particular, it is now recognized that enabling adjustability in the production of combustion products of the furnace system enables the furnace system to more efficiently discharge heated air at a target temperature setpoint.

Accordingly, embodiments of the present disclosure are directed to a furnace system that includes a control system configured to efficiently regulate production of the combustion products generated by the furnace system based on certain operational parameters of the HVAC system. For example, in some embodiments, the control system may adjust one or more gas valves of the furnace system, which are configured to regulate a flow rate of fuel or gas supplied to the burner assemblies, based on a temperature of the air flow discharging from the furnace system. As such, by regulating the gas flow supplied to the burner assemblies, the control system may control an amount of combustion products that are produced by the burner assemblies and are directed through the tubes or piping of the furnace system heat exchanger. Therefore, the control system may adjust a heat transfer rate between the heat exchanger and the air flowing thereacross based on a temperature of the air being exported from the furnace system. Thus, the control system may enable the furnace system to export heated air at a temperature that is substantially close to target temperature setpoint during operation of the HVAC system. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
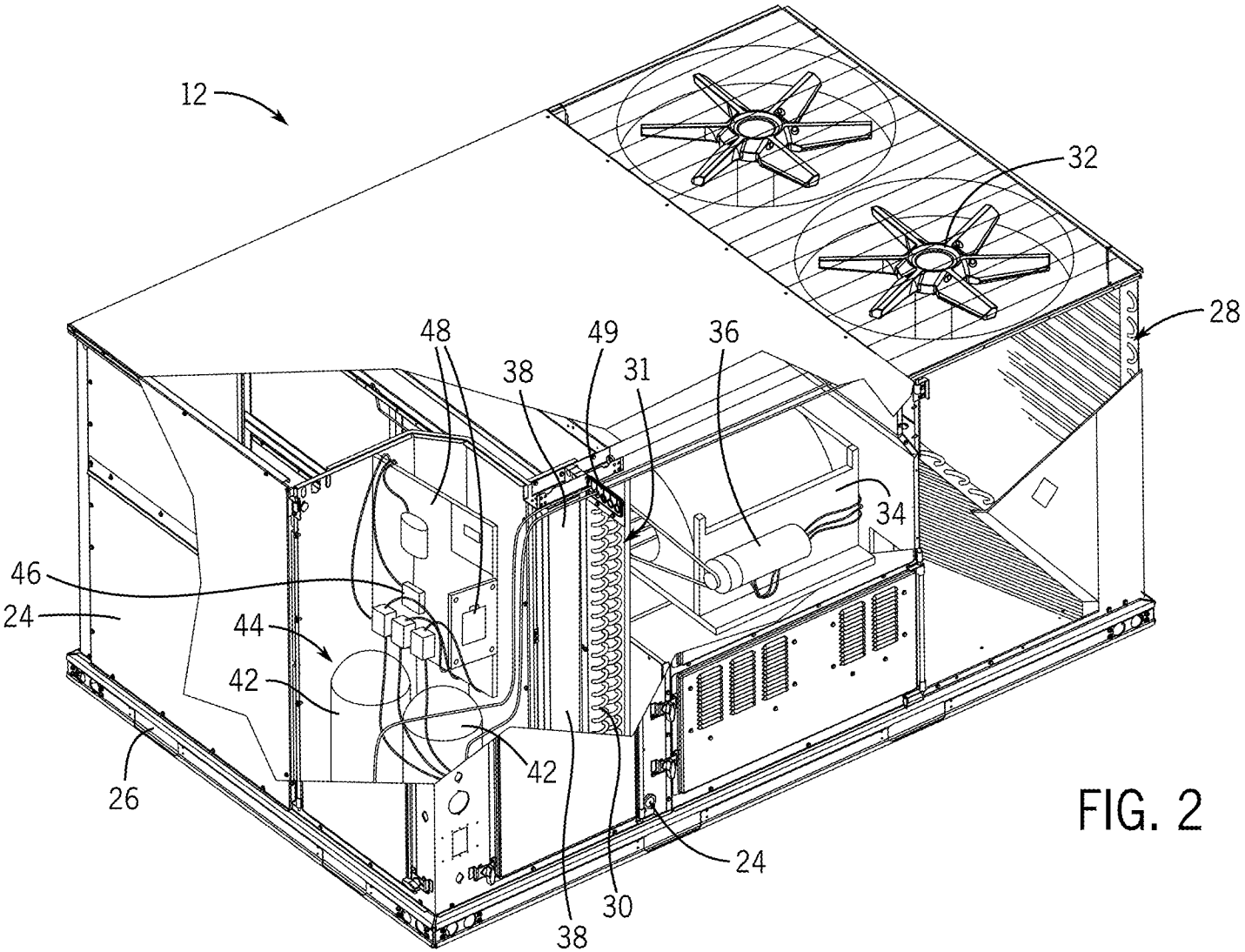
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
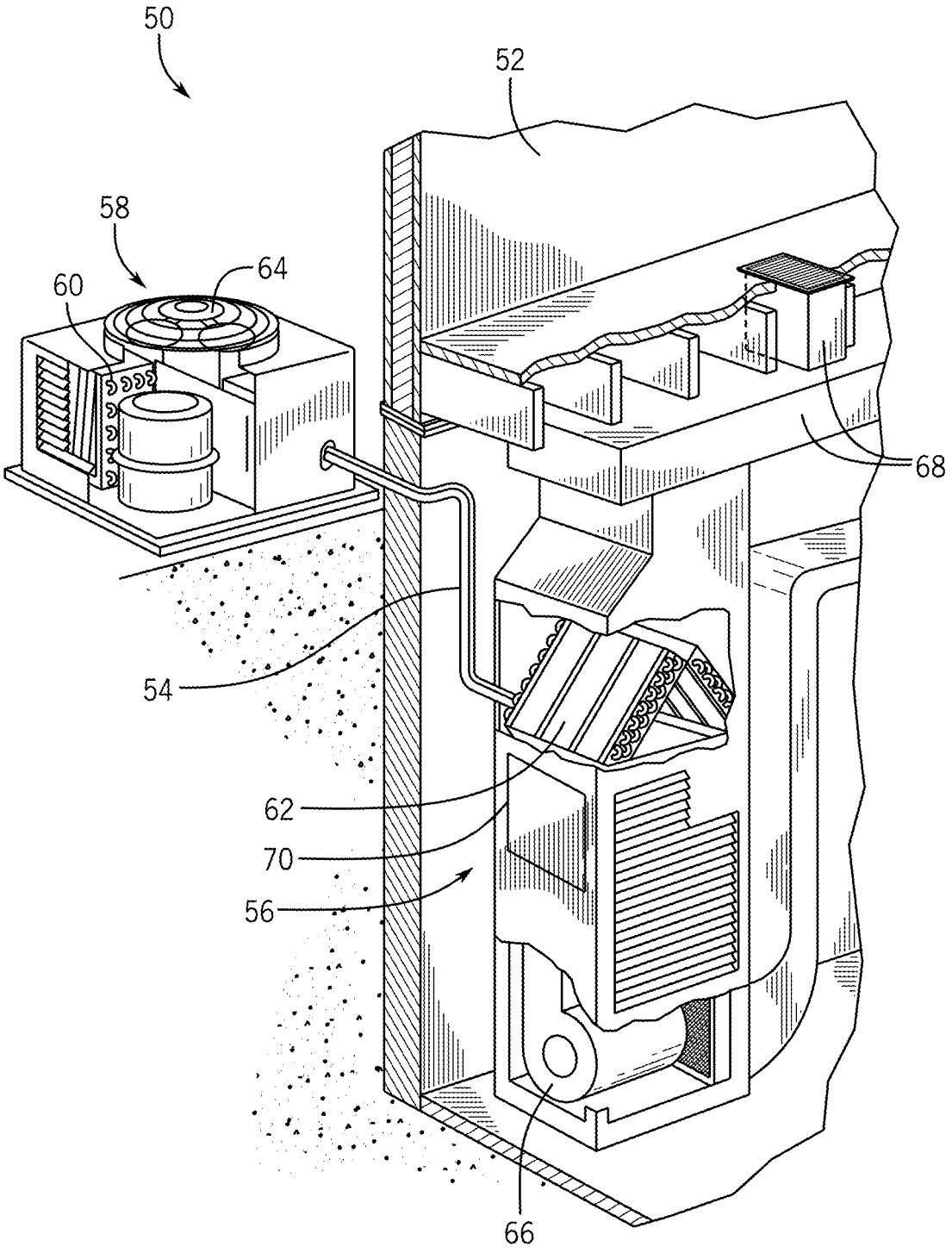
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
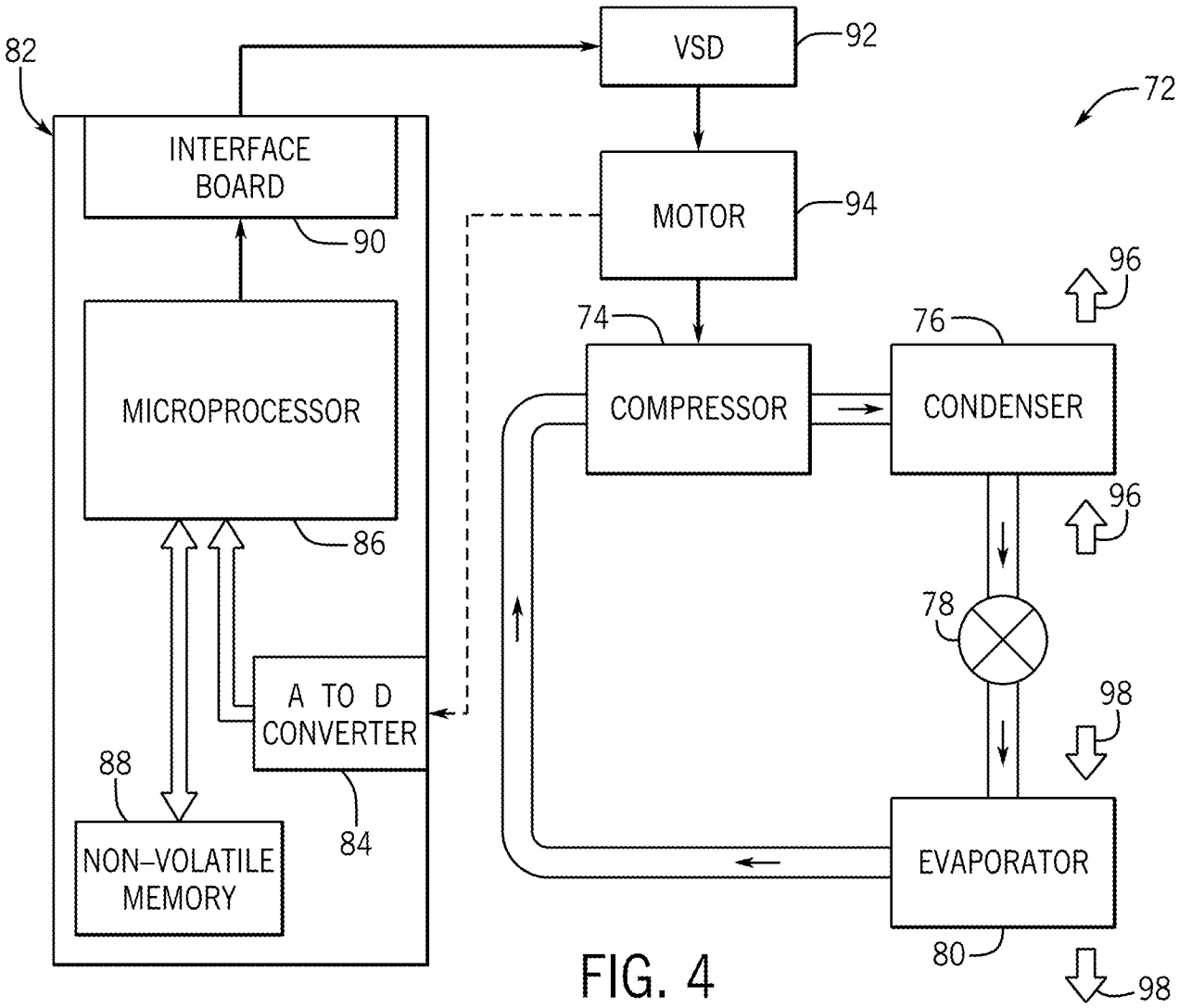
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
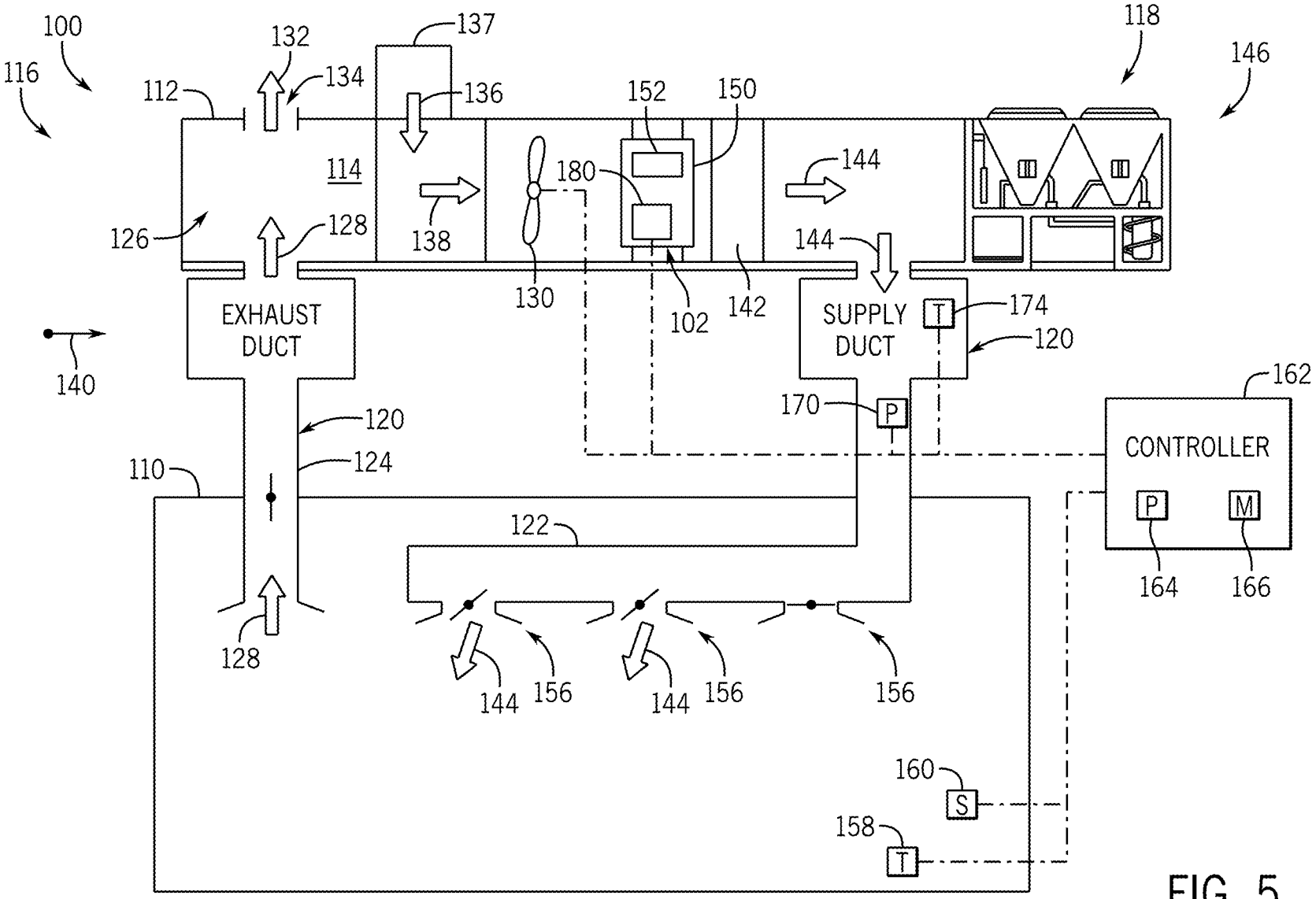
FIG. 5 is a schematic diagram of an embodiment of an HVAC system having a furnace system, in accordance with an aspect of the present disclosure.

As briefly discussed above, HVAC systems may include a furnace system that is configured to discharge heated air to a room or zone of a building. Embodiments of the present disclosure are directed to a control system that enables the furnace system to efficiently discharge heated air at a temperature this is substantially equal to a target temperature setpoint of the heated air. To provide context for the following discussion, FIG. 5 is a schematic of an embodiment of an HVAC system 100 having a furnace system 102. It should be noted that the HVAC system 100 may include embodiments or components of the HVAC unit 12 shown in FIG. 1, embodiments or components of the split residential heating and cooling system 50 shown in FIG. 3, a rooftop unit (RTU), or any other suitable air handling unit or HVAC system.

The HVAC system 100 may be configured to circulate a flow of conditioned air through a thermal load 110, such as conditioned space of a building, residential home, or other suitable structure. The HVAC system 100 includes an enclosure 112 that forms an air flow path 114 through the HVAC system 100. The air flow path 114 extends from an upstream end portion 116 of the HVAC system 100 to a downstream end portion 118 of the HVAC system 100. The enclosure 112 may be in fluid communication with the thermal load 110 via an air distribution system, or a system of ductwork 120, which includes a supply duct 122 and an exhaust duct 124. The exhaust duct 124 may be coupled to an exhaust air plenum 126 of the enclosure 112 that is configured to receive a flow of return air 128 from the thermal load 110. Particularly, a fan or blower 130 of the HVAC system 100 may be operable to draw the return air 128 into the enclosure 112 via the exhaust duct 124. In some embodiments, the HVAC system 100 may exhaust a portion of the return air 128 as exhaust air 132, which may discharge from the exhaust air plenum 126 and into an ambient environment, such as the atmosphere, via an exhaust air outlet 134 of the enclosure 112. The HVAC system 100 may intake fresh outdoor air 136 via an outdoor air inlet 137 of the enclosure 112 to replace the discharged exhaust air 132. The outdoor air 136 may mix with a remaining portion of the return air 128 to form mixed air 138, which the blower 130 may direct along the air flow path 114 in a downstream direction 140 from the upstream end portion 116 to the downstream end portion 118 of the HVAC system 100.

The HVAC system 100 may include a vapor compression system, such as the vapor compression system 72, which enables the HVAC system 100 to regulate one or more climate parameters within the thermal load 110. Particularly, the blower 130 may force the mixed air 138 across an evaporator assembly 142 of the vapor compression system 72 such that, in a cooling mode of the HVAC system 100, refrigerant circulating through evaporator coils of the evaporator assembly 142 to absorb thermal energy from the mixed air 138. Accordingly, the evaporator assembly 142 may discharge a flow of supply air 144 that is cooled and flows along the air flow path 114 toward the supply duct 122 and into the thermal load 110. A compressor of the vapor compression system 72 may circulate heated refrigerant from the evaporator assembly 142 to a condenser assembly 146 that, in some embodiments, may form the downstream end portion 118 of the HVAC system 100. The condenser assembly 146 may facilitate heat exchange between refrigerant circulating therethrough and the ambient environment, thereby cooling the refrigerant before the compressor recirculates the refrigerant toward the evaporator assembly 142 for reuse.

The HVAC system 100 also includes the furnace system 102 that, in a heating mode of the HVAC system 100, is configured to heat the mixed air 138 flowing along the air flow path 114. Accordingly, it should be understood that, in the heating mode of the HVAC system 100, operation of the evaporator assembly 142 is temporarily suspended. The furnace system 102 includes a frame 150 that is positioned within the enclosure 112 and is configured to support one or more furnace components 152 of the furnace system 102. As discussed in detail below, the furnace components 152 are operable to heat the mixed air 138 and, thus, enable the furnace system 102 to discharge heated supply air 144 that is directed into the supply duct 122 via the blower 130. In this manner, the HVAC system 100 may be operable to maintain a desired air quality, air humidity, and/or air temperature within the thermal load 110. For clarity, throughout the subsequent discussion, the HVAC system 100 will be described as operating in the heating mode with operation of the evaporator assembly 142 temporarily deactivated.

In some embodiments, the HVAC system 100 includes one or more variable air volume (VAV) units 156 that are coupled to the supply duct 122 and are configured to regulate discharge of the supply air 144 into various rooms or zones of the thermal load 110. For example, in certain embodiments, the VAV units 156 may be adjustable to increase or decrease a flow rate of the supply air 144 entering particular zones of the thermal load 110 based on temperature measurements acquired by corresponding temperature sensors 158 positioned within each of the zones. Additionally or alternatively, the VAV units 156 may be adjusted based on feedback from one or more auxiliary sensors 160, such as, for example, carbon dioxide sensors or humidity sensors positioned within each of the zones.

The HVAC system 100 includes a controller 162, such as the control panel 82, which may be used to control components of the HVAC system 100 and/or components of the furnace system 102. For example, one or more control transfer devices, such as wires, cables, wireless communication devices, and the like, may communicatively couple the blower 130, the VAV units 156, the temperature sensors 158, the auxiliary sensors 160, the furnace components 152, or any other suitable components of the HVAC system 100 and/or the furnace system 102 to the controller 162. That is, the blower 130, the VAV units 156, the temperature sensors 158, the auxiliary sensors 160, and the furnace components 152 may each have a communication component that facilitates wired or wireless communication between the controller 162, the blower 130, the VAV units 156, the temperature sensors 158, the auxiliary sensors 160, and the furnace components 152 via a network. In some embodiments, the communication component may include a network interface that enables the components of the HVAC system 100 and/or the components of the furnace system 102 to communicate via various protocols such as EtherNet/IP, ControlNet, DeviceNet, or any other communication network protocol. Alternatively, the communication component may enable the components of the HVAC system 100 and/or the components of the furnace system 102 to communicate via mobile telecommunications technology, Bluetooth®, near-field communications technology, and the like. As such, the controller 162, the blower 130, the VAV units 156, the temperature sensors 158, the auxiliary sensors 160, and the furnace components 152 may wirelessly communicate data between each other.

The controller 162 includes a processor 164, such as a microprocessor, which may execute software for controlling the components of the HVAC system 100 and/or components of the furnace system 102. The processor 164 may include multiple microprocessors, one or more "general-purpose" microprocessors, one or more special-purpose microprocessors, and/or one or more application specific integrated circuits (ASICS), or some combination thereof. For example, the processor 164 may include one or more reduced instruction set (RISC) processors. The controller 162 may also include a memory device 166 that may store information such as control software, look up tables, configuration data, etc. The memory device 166 may include a volatile memory, such as random access memory (RAM), and/or a nonvolatile memory, such as read-only memory (ROM). The memory device 166 may store a variety of information and may be used for various purposes. For example, the memory device 166 may store processor-executable instructions including firmware or software for the processor 164 execute, such as instructions for controlling components of the HVAC system 100 and/or for controlling components of the furnace system 102. In some embodiments, the memory device 166 is a tangible, non-transitory, machine-readable-medium that may store machine-readable instructions for the processor 164 to execute. The memory device 166 may include ROM, flash memory, a hard drive, or any other suitable optical, magnetic, or solid-state storage medium, or a combination thereof. The memory device 166 may store data, instructions, and any other suitable data.

In some embodiments, to facilitate efficient operation of the VAV units 156, the controller 162 may be configured to adjust an operational speed of the blower 130 based on a measured air pressure within the supply duct 122. For example, the HVAC system 100 may include a pressure sensor 170 that is positioned within the supply duct 122 and is configured to provide the controller 162 with feedback indicative of an air pressure within the supply duct 122. If a measured air pressure within the supply duct 122 falls below a target pressure setpoint, such as when one or more of the VAV units 156 are opened to increase a flow rate of supply air 144 discharging from the supply duct 122, the controller 162 may send instructions to increase an operational speed of the blower 130. Accordingly, the blower 130 may increase a flow rate of the mixed air 138 directed across the furnace system 102 and, thus, increase a flow rate of the supply air 144 entering the supply duct 122. As such, the blower 130 may increase a pressure within the supply duct 122 and enable the pressure within the supply duct 122 to approach the target pressure setpoint. Conversely, if a measured air pressure within the supply duct 122 rises above a target pressure setpoint, such as when one or more of the VAV units 156 are closed to decrease a flow rate of supply air 144 discharging from the supply duct 122, the controller 162 may send instructions to decrease an operational speed of the blower 130. As such, the blower 130 may decrease a flow rate of the mixed air 138 directed across the furnace system 102 and, thus, decrease a flow rate of the supply air 144 entering the supply duct 122. Accordingly, the blower 130 may decrease a pressure within the supply duct 122 and enable the pressure within the supply duct 122 to approach the target pressure setpoint. As such, it should be understood that the controller 162 may modulate a speed of the blower 130 in response to feedback received from the pressure sensor 170.

In some embodiments, the controller 162 may be configured to monitor a temperature of the supply air 144 discharging from the furnace system 102 via a temperature sensor 174 that is positioned within, for example, the supply duct 122, and is configured to provide the controller 162 with feedback indicative of a temperature of the supply air 144. The controller 162 may be configured to adjust a heat generation rate of the furnace components 152 when a measured temperature of the supply air 144 deviates from a target temperature setpoint of the supply air 144. In this manner, the controller 162 may account for temperature fluctuations of the supply air 144 that may occur when a flow rate of the mixed air 138 being directed across the furnace components 152 is varied by the blower 130 and/or when an amount of the return air 128 and/or outdoor air 136 within the mixed air 138 is varied.

For example, in some embodiments, feedback from the temperature sensor 174 may indicate that a temperature of the supply air 144 falls below a target temperature setpoint when the blower 130 increases a flow rate of the mixed air 138 supplied to the furnace system 102. Accordingly, the controller 162 may adjust operation of the furnace components 152 to increase a heat generation rate of the furnace components 152 and, thus, enable a temperature of the supply air 144 to increase and to approach the target temperature setpoint. Conversely, if the feedback from the temperature sensor 174 indicates that a temperature of the supply air 144 reaches or rises above the target temperature setpoint, such as when the blower 130 decreases a flow rate of the mixed air 138 supplied to the furnace system 102, the controller 162 may adjust operation of the furnace components 152 to decrease a heat generation rate of the furnace components 152. In this manner, the controller 162 may modulate a rate of heat output by the furnace components 152 to ensure that an actual temperature of the supply air 144 remains substantially similar to the desired temperature setpoint of the supply air 144 regardless of a flow rate of the mixed air 138 being directed across the furnace system 102.

As discussed in detail below, the controller 162, the temperature sensor 158, and the furnace components 152 may collectively form a control system 180 of the furnace system 102, which is configured to incrementally adjust a heat output rate of the furnace system 102 to ensure that the actual temperature of the supply air 144 remains substantially similar to the target temperature setpoint of the supply air 144. It should be appreciated that, although the controller 162 is discussed herein as controlling both the HVAC system 100 and the furnace system 102, in other embodiments, a plurality of separate controllers may be used to operate components of the HVAC system 100 and/or components of the furnace system 102. For example, the control system 180 may include a dedicated controller that is configured to operate the furnace components 152 and is configured to communicate with a master controller, such as the controller 162, which may control operation of other components of the HVAC system 100.

Figure 6:
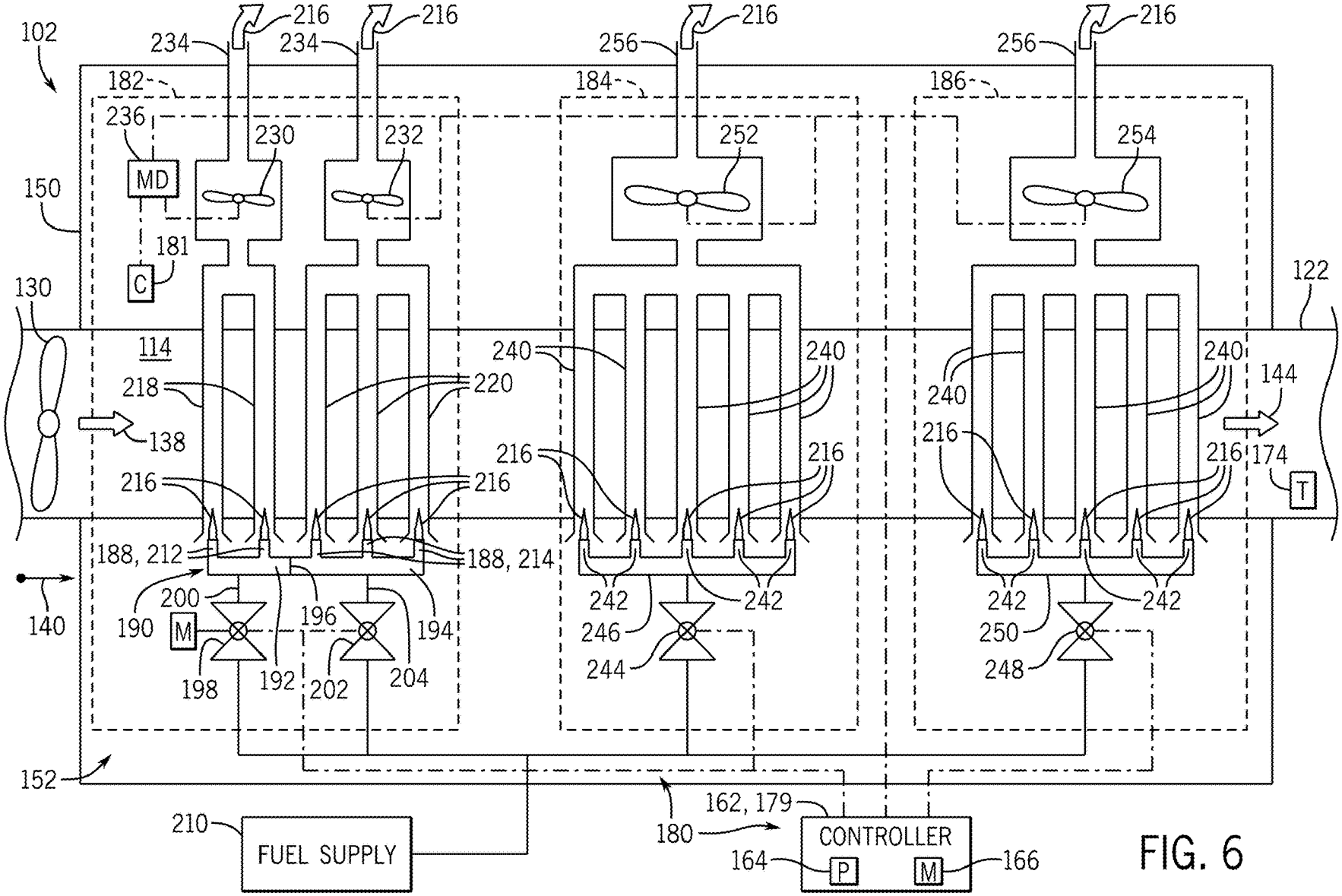
FIG. 6 is a schematic diagram of an embodiment of a furnace system for an HVAC system, in accordance with an aspect of the present disclosure.

With the foregoing in mind, FIG. 6 is a schematic of an embodiment of the furnace system 102. In the illustrated embodiment, the furnace system 102 include a first heating module 182, a second heating module 184, and a third heating module 186 that, as discussed in detail below, are operable to heat the mixed air 138 flowing along the air flow path 114. The first heating module 182 includes one or more burner assemblies 188 that are fluidly coupled to a split manifold 190. The split manifold 190 is divided into a first chamber 192 and a second chamber 194 via a divider 196. In some embodiments, the first chamber 192 is fluidly coupled to a first valve, referred to herein as a modulating valve 198, via a conduit 200, and the second chamber 194 is fluidly coupled to a second valve 202, such as a two-stage valve, via a conduit 204. For clarity, as used herein, a "modulating valve" may refer to any suitable valve or flow control device, such as a step-less valve, which is operable to incrementally adjust a flow rate and/or a flow pressure of a fluid flow across the modulating valve. For example, in some embodiments, the modulating valve 198 may be adjustable to 1, 3, 5, 10, 20, 30, 50, or more than 50 discrete positions that enable precise adjustment of fluid flow parameters across the modulating valve 198. As used herein, a "two-stage valve" may refer to any suitable valve or flow control device that is adjustable between a closed position, an intermediate position or a first stage position, and an open position or a second stage position. Accordingly, a two-stage valve, such as the second valve 202, may be adjustable to block fluid flow through, for example, the conduit 204, to enable a first flow rate, such as a relatively low flow rate, of fluid flow through the conduit 204, or to enable a second flow rate, such as a relatively high flow rate, of fluid flow through the conduit 204.

The modulating valve 198 and the second valve 202 are fluidly coupled to a gas supply 210 or a fuel supply, such as a gas supply line of the building 10, thereby enabling the modulating valve 198 and the second valve 202 to respectively control a flow rate of gas or fuel entering the first chamber 192 and the second chamber 194 of the split manifold 190. In the illustrated embodiment, the first chamber 192 is fluidly coupled to a first set of the burner assemblies 188, referred to herein as a first set of burner assemblies 212, and the second chamber 194 is fluidly coupled to a second set of the burner assemblies 188, referred to herein as a second set of burner assemblies 214. It should be understood that the first and second sets of burner assemblies 212, 214 may each include one or more individual burners. The first and second sets of burner assemblies 212, 214 are configured to combust fuel or gas to generate hot combustion products that form a working fluid 216. A first plurality of heat exchange tubes 218 are in fluid communication with the first set of burner assemblies 212 and are configured to receive a first flow of the working fluid 216. A second plurality of heat exchange tubes 220 are in fluid communication with the second set of burner assemblies 214 and are configured to receive a second flow of the working fluid 216. The first and second pluralities of heat exchange tubes 218, 220 extend across the air flow path 114 to facilitate heat transfer between the working fluid 216 within the heat exchange tubes 218, 220 and the mixed air 138 flowing thereacross. It should be appreciated that, in certain embodiments, the first plurality of heat exchange tubes 218 and the second plurality of heat exchange tubes 220 may each include only a single heat exchange tube.

In some embodiments, the first plurality of heat exchange tubes 218 is fluidly coupled to a first draft inducer blower 230, and the second plurality of heat exchange tubes 220 is fluidly coupled to a second draft inducer blower 232. The first and second draft inducer blowers 230, 232 are configured to draw the working fluid 216 through the first plurality of heat exchange tubes 218 and the second plurality of heat exchange tubes 220, respectively, and are configured to exhaust the working fluid 216 from the heat exchange tubes 218, 220 into an ambient environment, such as the atmosphere, via respective outlets 234. In some embodiments, the first draft inducer blower 230 is electrically coupled to a motor drive 236 that, as discussed below, is configured to adjust an operational speed of the first draft inducer blower 230 based on a position of the modulating valve 198 and/or based on a temperature of the supply air 144. For example, the motor drive 236 may enable adjustment of the operational speed of a motor of the first draft inducer blower 230 between 3, 5, 10, 20, 50, 100, or more than 100 particular speed increments. In some embodiments, the motor drive 236 may include a variable frequency drive (VFD) or another suitable drive system that is electrically coupled to a motor of the first draft inducer blower 230 to enable adjustment of the operational speed of the first draft inducer blower 230. It should be understood that, in certain embodiments, the motor drive 236 may be integrated with the first draft inducer blower 230. For example, in some embodiments, a motor of the first draft inducer blower 230 may include an electronically commutated motor (ECM), and the motor drive 236 may include a processing unit that is integrated with the ECM or is external to the ECM and used to control a speed of the ECM. Indeed, it should be understood that any suitable motor drive system may be used to adjust an operational speed of the first draft inducer blower 230 in accordance with the techniques discussed herein. In certain embodiments, the second draft inducer blower 232 may include a two-speed blower that, when activated, may be selectively adjusted between a first operational speed, such as a relatively low operational speed, and a second operational speed, such as a relatively high operational speed. That is, as used herein, a "two-speed blower" may refer to a blower that is adjustable between an inactive or non-operational state, a first operational speed, and a second operational speed that is greater than the first operational speed. It should be understood that, in some embodiments, the controller 162 may include a controller system including a first automation controller 179 configured to control the modulating valve 198 and a second automation controller 181 configured to control the motor drive 236. The first automation controller 179 and the second automation controller 181 may be communicatively coupled to one another using any of the aforementioned wired or wireless connections. In some embodiments, the controller 162 may be configured to, via the motor drive 236, adjust the speed of the first draft inducer blower 230 to maintain an efficiency of the first draft inducer blower 230 at approximately 81 percent, such as between about 81 percent and 81.5 percent, during operation of the furnace system 102.

It should be noted that, in certain embodiments, the second valve 202, the second set of burner assemblies 214, the second plurality of heat exchange tubes 220, and the second draft inducer blower 232 may be omitted from the first heating module 182. In such embodiments, the second chamber 194 of the split manifold 190 may also be omitted, such that the split manifold 190 includes the first chamber 192. In such embodiments, the first heating module 182 may include the modulating valve 198, the first set of burner assemblies 212, the first plurality of heat exchange tubes 218, and the first draft inducer blower 230.

In any case, similar to the first heating module 182, the second heating module 184 and the third heating module 186 may each include a plurality of heat exchange tubes 240 that is positioned within the air flow path 114 and is configured to receive a flow of the working fluid 216 from respective burner assemblies 242. The second heating module 184 includes a third valve 244, such as a two-stage valve, which is fluidly coupled to the gas supply 210 and is configured to adjust a flow rate of gas that is directed to a manifold 246 associated with the burner assemblies 242 of the second heating module 184. The third heating module 186 includes a fourth valve 248, such as a two-stage valve, which is fluidly coupled to the gas supply 210 and is configured to adjust a flow rate of gas that is directed to a manifold 250 associated with the burner assemblies 242 the third heating module 186. Accordingly, the third valve 244 and the fourth valve 248 may be used to adjust a flow rate of gas supplied to the manifolds 246, 250 to regulate an amount of the working fluid 216 that is generated by the burner assemblies 242 and is directed through the heat exchange tubes 240.

In the illustrated embodiment, the heat exchange tubes 240 of the second heating module 184 and the heat exchange tubes 240 of the third heating module 186 are fluidly coupled to a third draft inducer blower 252 and to a fourth draft inducer blower 254, respectively, which are configured to draw the working fluid 216 through the heat exchange tubes 240 and to discharge the working fluid 216 into an ambient environment via respective outlets 256. Similar to the second draft inducer blower 232, the third draft inducer blower 252 and the fourth draft inducer blower 254 may each include a two-speed blower that, when activated, may be selectively adjusted to operate at a first operational speed, such as a relatively low operational speed, and a second operational speed, such as a relatively high operational speed. As such, the second and third heating modules 184, 186 are operable alongside the first heating module 182 to enable the mixed air 138 to absorb thermal energy from the working fluid 216 flowing through the heat exchange tubes 218, 220, 240, thereby heating the mixed air 138. Accordingly, the furnace system 102 facilitates discharge of the heated supply air 144, which may be directed toward the thermal load 110 via the supply duct 122.

It should be noted that the illustrated embodiment of the furnace system 102 is intended to facilitate the present discussion and is not intended to limit the scope of this disclosure. For example, it should be understood that, although each of the first, second, and third heating modules 182, 184, 186 include five heat exchange tubes and five burner assemblies in the illustrated embodiment, in other embodiments, the first, second, and third heating modules 182, 184, 186 may each include, for example, 1, 2, 3, 4, 5, 10, 15, or more than 15 heat exchange tubes and/or corresponding burner assemblies. Moreover, it should be appreciated that, in certain embodiments, the furnace system 102 may include 1, 2, 3, 4, 5, or more than 5 heating modules.

With the foregoing in mind, as shown in the illustrated embodiment, the controller 162 may be communicatively coupled to the valves 198, 202, 244, 248 and the draft inducer blowers 230, 232, 252, 254 via suitable wired or wireless communication components. The controller 162 is configured to adjust operation of the valves 198, 202, 244, 248 and the draft inducer blowers 230, 232, 252, 254 to regulate a heat exchange rate between the first, second, and third heating modules 182, 184, 186 and the mixed air 138. In this manner discussed below, the controller 162 may enable the furnace system 102 to discharge the supply air 144 at a temperate that is substantially similar to a target temperature setpoint of the supply air 144. For example, the furnace system 102 may discharge supply air 144 at a desired temperature regardless of a flow rate of the mixed air 138 entering or directed through the furnace system 102. For example, the controller 162 may adjust operation of the valves 198, 202, 244, 248 and the draft inducer blowers 230, 232, 252, 254 to ensure that a temperature of the supply air 144 remains substantially similar to the target temperature setpoint of the supply air 144 even when the blower 130 increases or decreases a flow rate of the mixed air 138 to maintain a particular air pressure within the supply duct 122.

Figure 7:
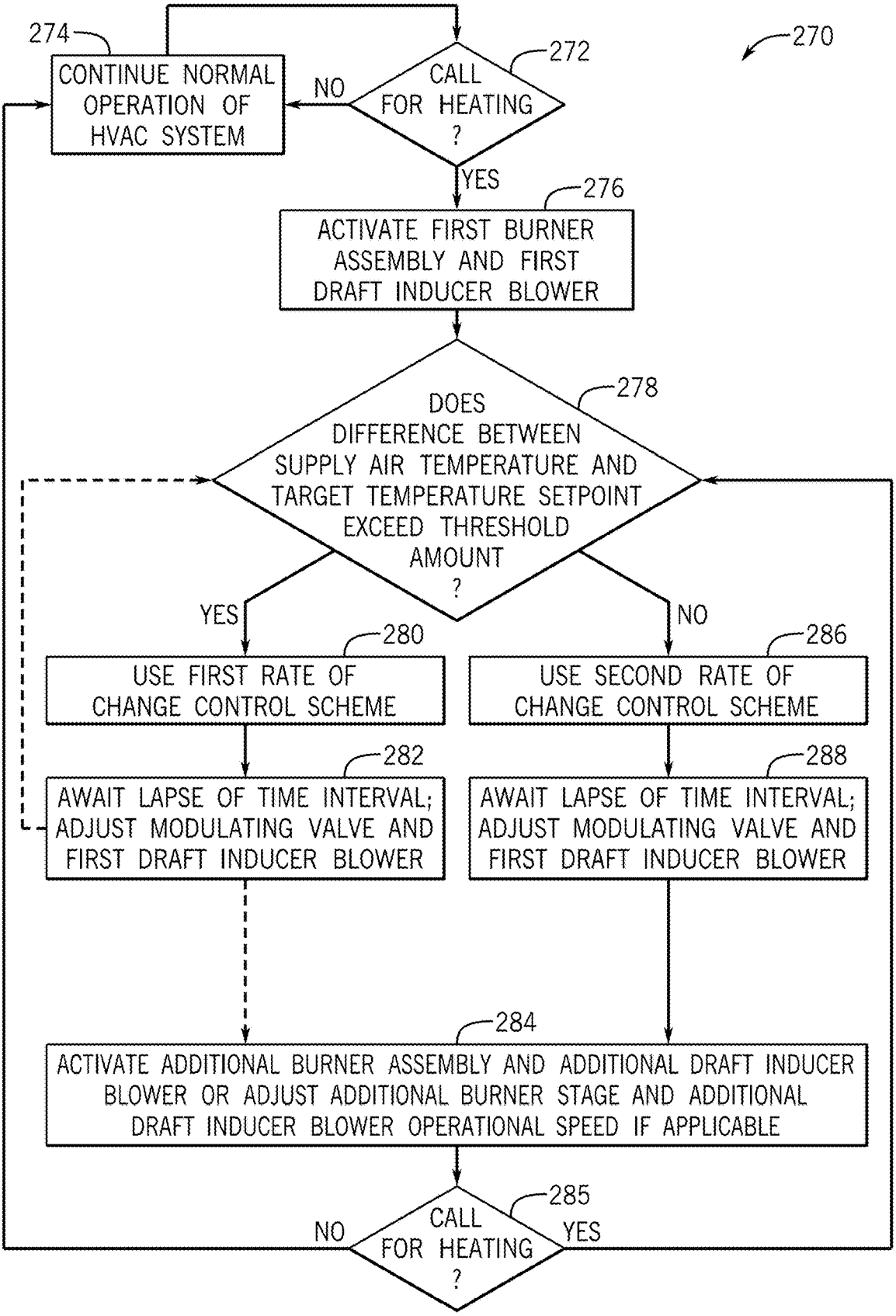
FIG. 7 is a flow diagram of an embodiment of a process of operating a furnace system, in accordance with an aspect of the present disclosure.

FIG. 7 is flow diagram of an embodiment of a process 270 that may be used to control the furnace system 102 to facilitate temperature regulation of the supply air 144. FIG. 7 will be referred to concurrently with FIGS. 5 and 6 throughout the following discussion. It should be noted that the steps of the process 270 discussed below may be performed in any suitable order and are not limited to the order shown in the illustrated embodiment of FIG. 7. Moreover, it should be noted that additional steps of the process 270 may be performed, and certain steps of the process 270 may be omitted. In some embodiments, the process 270 may be executed by the processor 164, the microprocessor 86, and/or any other suitable processor of the furnace system 102 and/or the HVAC system 100. The process 270 may be stored on, for example, the memory 88 or the memory device 166.

The process 270 may begin with determining whether one or more rooms or zones of the building 10 call for heating, as indicated by step 272. In some embodiments, the controller 162 may determine that a call for heating exists when feedback from the temperature sensor 174 indicates that a temperature of the supply air 144 is below a target temperature setpoint by a threshold amount, such as, for example, 0.2 degrees Fahrenheit, 1.0 degree Fahrenheit, or 2.0 degrees Fahrenheit. Additionally or alternatively, the controller 162 may determine that a call for heating exists when the control device 16, the temperature sensors 158, and/or other suitable thermostats within the building 10 provide feedback indicating that a temperature within one or more rooms or zones of the building 10 is below the target temperature setpoint by the threshold amount. If the controller 162 determines that no call for heating exists, the controller 162 continues normal operation of the HVAC system 100, as indicated by step 274. During normal operation or non-heating operation of the HVAC system 100, the controller 162 does not activate the furnace system 102. If the controller 162 determines that a call for heating exists, the controller 162 may activate the first set of burner assemblies 212 and the first draft inducer blower 230 of the furnace system 102, as indicated by the step 276.

For example, to activate the first set of burner assemblies 212, the controller 162 may instruct the modulating valve 198 to transition to an initial flow position to direct fuel into the first chamber 192 and may instruct respective igniters of the first set of burner assemblies 212 to ignite the fuel. Accordingly, the first set of burner assemblies 212 may discharge the working fluid 216 into the first plurality of heat exchange tubes 218. The initial flow position of the modulating valve 198 may be indicative of any suitable position of the modulating valve 198 that enables fuel to enter the first chamber 192 at a particular flow rate and/or flow pressure. As an example, in some embodiments, the initial flow position may include an idle flow position of the modulating valve 198. For clarity, as used herein, the "idle flow position" of the modulating valve 198 may refer to a position of the modulating valve 198 that enables fuel to enter the first chamber 192 at a lowest flow rate threshold that is adequate to sustain operation of the first set of burner assemblies 212.

Moreover, at the step 276, the controller 162 may, via instructions sent to the motor drive 236, begin operation of the first draft inducer blower 230. As discussed below, in some embodiments, an operational speed of the first draft inducer blower 230 may be based on a position of the modulating valve 198. Accordingly, when the modulating valve 198 is in the initial flow position, the controller 162 may instruct the motor drive 236 to operate the first draft inducer blower 230 at an initial speed, such as a relatively low operational speed, which is associated with the initial flow position of the modulating valve 198. Accordingly, the first draft inducer blower 230 may draw the working fluid 216 through the first plurality of heat exchange tubes 218 to facilitate heat exchange between the mixed air 138 and the first plurality of heat exchange tubes 218.

Upon activating the first set of burner assemblies 212 and the first draft inducer blower 230, the controller 162 may determine, as indicated by step 278, whether a difference between the measured temperature of the supply air 144 and a target temperature setpoint of the supply air 144 exceeds a threshold amount, such as, for example, three degrees Fahrenheit. The controller 162 may be configured to select a rate-of-change control scheme by which to control the modulating valve 198 and the first draft inducer blower 230 based on the temperature differential between the supply air 144 and the target temperature setpoint of the supply air 144. The particular rate-of-change control scheme selected by the controller 162 may determine a rate at which the controller 162 adjusts operation of the modulating valve 198, the first draft inducer blower 230, and/or other furnace components 152 during operation of the HVAC system 100 to effectuate a desired change in the rate of heat transfer from the furnace system 102 to the mixed air 138.

For example, if the difference between the measured temperature of the supply air 144 and the target temperature setpoint of the supply air 144 exceeds the threshold amount, the controller 162 may select a first rate-of-change control scheme, as indicated by step 280, and may operate the modulating valve 198 and/or other furnace components 152 in accordance with the first rate-of-change control scheme, as indicated by step 282. When operating the modulating valve 198 in accordance with the first rate-of-change control scheme, the controller 162 may incrementally adjust or update a position of the modulating valve 198 after lapse of a first time interval such as, for example, sixty seconds. For example, if the first rate-of-change control scheme is selected at the step 280, and the first time interval has lapsed at the step 282, the controller 162 may instruct the modulating valve 198 to further open by a particular adjustment increment. Accordingly, the controller 162 may increase a flow rate of fuel supplied to the first set of burner assemblies 212 and, thus, increase an amount of the working fluid 216 produced by the first set of burner assemblies 212. In addition to further opening the modulating valve 198 by the adjustment increment, the controller 162 may also increase an operational speed the first draft inducer blower 230 to an elevated operational speed that, in some embodiments, is associated with the updated position of the modulating valve 198. Accordingly, the first draft inducer blower 230 may more effectively draw the working fluid 216 through the first plurality of heat exchange tubes 218 to facilitate heat exchange between the working fluid 216 and the mixed air 138 flowing across the first plurality of heat exchange tubes 218.

In some embodiments, upon adjusting the position of the modulating valve 198 and the operational speed of the first draft inducer blower 230, the controller 162 may return to the step 278 and determine, via feedback from the temperature sensor 174, whether the temperature of the supply air 144 is within a threshold range of the target temperature setpoint of the supply air 144. If the measured temperature of the supply air 144 is still below the target temperature setpoint of the supply air 144 by the threshold amount, the controller 162 may continue to operate the modulating valve 198 and the first draft inducer blower 230 in accordance with the first rate-of-change control scheme, as indicated by the step 280. In particular, the controller 162 may iteratively repeat the steps 278, 280, and 282 to sequentially open the modulating valve 198 by the adjustment increment, as well as to sequentially increase the operational speed of the first draft inducer blower 230 by a corresponding amount. It should be understood that the controller 162 may wait for the first time interval to lapse at the step 280 during each iteration of the steps 278, 280, and 282. Accordingly, by incrementally increasing an amount of the working fluid 216 generated by the first set of burner assemblies 212, the controller 162 may incrementally increase a heat transfer rate between the first heating module 182 and the mixed air 138.

In some embodiments, if the modulating valve 198 reaches a terminal position after one or more iterations of the steps 278, 280, and 282, and the temperature of the supply air 144 is still below the target temperature setpoint by the threshold amount, the controller 162 may activate an additional burner assembly and a corresponding draft inducer blower of the furnace system 102, as indicated by step 284. For clarity, as used herein, the "terminal position" of the modulating valve 198 may include any suitable position of the modulating valve 198 that enables fuel flow through the modulating valve 198 at a particular flow rate and/or flow pressure. As an example, in some embodiments, the terminal position of the modulating valve 198 may be a fully open position of the modulating valve 198. In other embodiments, the terminal position of the modulating valve 198 may be a position of the modulating valve 198 that is between the idle flow position of the modulating valve 198 and the fully open position of the modulating valve 198. If the modulating valve 198 has reached the terminal position at the step 282 during a previous iteration of the process 270, the controller 162 may, in a subsequent iteration of the process 270, at the step 284, instruct the second valve 202 to transition from a closed position to a first stage position, as well as instruct the modulating valve 198 to transition to a staging flow position. In addition, the controller 162 may initiate operation of the second set of burner assemblies 214 and may instruct the second draft inducer blower 232 to activate and operate at a first stage speed, which corresponds to the first stage position of the second valve 202. For clarity, as used herein, a new "iteration of the process 270" may begin each time the controller 162 performs the step 278. As used herein, a "staging flow position" of the modulating valve 198 may be indicative of any suitable position of the modulating valve 198 that enables fuel to enter the first chamber 192 at a particular flow rate and/or flow pressure. By activating the second set of burner assemblies 214 at a low stage setting, which corresponds to the first stage position of the second valve 202, while transitioning the modulating valve 198 to the staging flow position, the controller 162 may ensure that an overall heat output rate of the first heating module 182 remains relatively constant or increases slightly when the second set of burner assemblies 214 is activated alongside the first set of burner assemblies 212. For example, operation of the second set of burner assemblies 214 and the second draft inducer blower 232 at the low or first stage setting alongside operation of the first set of burner assemblies 212 and the first draft inducer blower 232 at a capacity corresponding to the staging flow position of the modulating valve 198 may enable or produce a substantially similar amount of heat transfer to the mixed air 138 as operation of the first set of burner assemblies 212 and the first draft inducer blower 230 at the terminal capacity previously described. Thus, initiating operation of the second set of burner assemblies 214 at the low stage and reducing operation of the first set of burner assemblies 212 to the staging flow operation may result in a relatively small change in the rate of heat transfer from the furnace system 102 to the mixed air flow 138.

Upon activation of the second set of burner assemblies 214, the controller 162 may determine whether a call for heating still exists, as indicated by step 285. For example, the controller 162 may determine that a call for heating exists when the control device 16, the temperature sensors 158, and/or other suitable thermostats within the building 10 provide feedback indicating that a temperature within one or more rooms or zones of the building 10 is below the target temperature setpoint by the threshold amount. It should be appreciated that, in some embodiments, the controller 162 may proceed to the step 285 upon execution of the step 282, such that the controller 162 may skip the step 284. In any case, if the controller 162 determines that no call for heating exists, the controller 162 continues normal operation of the HVAC system 100, as indicated by the step 274. During normal operation or non-heating operation of the HVAC system 100, the controller 162 may deactivate the furnace system 102. Upon determining that a call for heating does exist at the step 285, the controller 162 may again iterate through the steps 278, 280, and 282 to incrementally open the modulating valve 198 and gradually increase an amount of the working fluid 216 generated by the first set of burner assemblies 212. Accordingly, through the coordinated operation of the modulating valve 198 and the valve 202, the controller 162 may adjust operation of the first heating module 182 to output thermal energy at multitudinous particular heat output rates. Moreover, the coordinated operation of the valves 198, 202 enables the controller 162 to increase an overall heat output rate of the first heating module 182 in a relatively linear manner by incrementally increasing an amount of the working fluid 216 generated by the burner assemblies 188 of the first heating module 182.

If the second valve 202 is in the first stage position and the modulating valve 198 reaches the terminal position after one or more iterations of the steps 278, 280, and 282, the controller 162 may, in a subsequent iteration of the process 270, at the step 284, instruct the second valve 202 to open to a second stage position and instruct the modulating valve 198 to transition to a staging flow position that may be the same as, or different than, the staging flow position of the modulating valve 198 discussed previously. In addition, the controller 162 may increase an operational speed of the second draft inducer blower 232 to a second stage speed, which is greater than the first stage speed, and which corresponds to the second stage position of the second valve 202. As such, by operating the second set of burner assemblies 214 at a high stage setting, which corresponds to the second stage position of the second valve 202, while transitioning the modulating valve 198 to the staging flow position, the controller 162 may ensure that an overall heat output rate of the first heating module 182 remains relatively constant or increases slightly when the second set of burner assemblies 214 is transitioned from the low stage setting to the high stage setting. In other words, as similarly described above, operation of the second set of burner assemblies 214 at the second or higher stage alongside operation of the first set of burner assemblies 212 and the first draft inducer blower 232 at a capacity corresponding to the staging flow position of the modulating valve 198 may produce a similar amount of heat transfer to the mixed air 138 as operation of the second set of burner assemblies 214 at the first stage combined with operation of the first set of burner assemblies 212 at the terminal capacity previously described.

Accordingly, it should be appreciated that the staging flow position of the modulating valve 198 may be adjusted at various iterations of the process 270. For example, the modulating valve 198 may be transitioned to a particular staging flow position when the second valve 202 is transitioned from a closed position to the first stage position at an iteration of the process, and may be transitioned to a different staging flow position when the second valve 202 is transitioned from the first stage position to the second stage position during a subsequent iteration of the process 270. Moreover, it should be appreciated that, in certain embodiments, the controller 162 may activate both the first and second sets of burner assemblies 212, 214 when receiving an initial call for heating, and may subsequently operate the modulating valve 198 in accordance with the techniques discussed herein.

In some embodiments, if the difference between the measured temperature of the supply air 144 and the target temperature setpoint of the supply air 144 continues to exceed the threshold amount after the second set of burner assemblies 214 are transitioned to the high stage setting, the controller 162 may repeatedly iterate through the steps 278, 280, 282, 284, and/or 285 to incrementally adjust the modulating valve 198, the first draft inducer blower 230, and/or additional furnace components 152 in accordance with the first rate-of-change scheme. For example, if second valve 202 is in the second stage position, and the modulating valve 198 again reaches the terminal position or full capacity position after one or more iterations through the steps 278, 280, 282, the controller 162 may, in a subsequent iteration of the process 270, at the step 284, instruct the third valve 244 of the second heating module 184 to open to the first stage position and instruct the modulating valve 198 to transition to a staging flow position. In addition, the controller 162 may initiate operation of the burner assemblies 242 associated with the second heating module 184 and may instruct the third draft inducer blower 252 to activate and operate at a first stage speed, which corresponds to the first stage position of the third valve 244. By activating the burner assemblies 242 associated with the second heating module 184 at a low stage setting, which corresponds to the first stage position of the third valve 244, while transitioning the modulating valve 198 to the staging flow position, and while maintaining the second set of burner assemblies 214 at the high stage setting, the controller 162 may ensure that an overall heat output rate of furnace system 102 remains relatively constant or increases slightly when the second heating module 184 is activated alongside the first heating module 182. For example, operation of the first set of burner assemblies 212 and the first draft inducer blower 230 at the staging capacity, operation of the second set of burner assemblies 214 and the second draft inducer blower 232 at the high or second stage setting previously described, and operation of the burner assemblies 242 associated with the second heating module 184 at the low stage setting may enable or produce a substantially similar amount of heat transfer to the mixed air 138 as operation of the first set of burner assemblies 212 and the first draft inducer blower 230 at the terminal capacity previously described and operation of the second set of burner assemblies 214 and the second draft inducer blower 232 at the high or second stage setting previously described.

The controller 162 may control of the valves 198, 202, 244, and/or 248 in accordance with the techniques discussed above to activate additional heating modules of the furnace system 102 and/or to gradually increase a heat output rate of the heating modules while a difference between the measured temperature of the supply air 144 and the target temperature of the supply air 144 continues to exceed the threshold amount. That is, the controller 162 may gradually increase a heat output rate of the furnace system 102 by iteratively adjusting a position of the modulating valve 198 in accordance with the first control scheme, as well as transitioning the third valve 244 and the fourth valve 248 to corresponding the first stage positions or the second stage positions at appropriate times. For example, when the modulating valve 198 reaches the terminal position at an iteration of the process 270, the controller 162 may, in a subsequent iteration of the process 270, instruct the third valve 244 to transition to the second stage position, instruct the third draft inducer blower 252 to transition to the second stage speed, and instruct the modulating valve 198 to transition to a staging flow position. If the modulating valve 198 again reaches the terminal position at a further iteration of the process 270, the controller 162 may, in a subsequent iteration of the process 270, instruct the fourth valve 248 to transition to the first stage position, activate the burner assemblies 242 of the third heating module 186, instruct the fourth draft inducer blower 252 to transition to the first stage speed, and instruct the modulating valve 198 to transition to a staging flow position. If the modulating valve 198 again reaches the terminal position at a further iteration of the process 270, the controller 162 may, in a subsequent iteration of the process 270, instruct the fourth valve 248 to transition to the second stage position, instruct the fourth draft inducer blower 252 to transition to the second stage speed, and instruct the modulating valve 198 to transition to a staging flow position. Accordingly, it should be understood that, in some embodiments, a heat output of each stage of the first, second, and third heating modules 182, 184, 186 may be selected such that, when an additional heating module is activated or when an additional stage of a heating module is activated, in combination with the modulating valve 198 transitioning to a particular staging flow position, an overall heat transfer rate between the furnace system 102 and the mixed air 138 remains relatively constant or increases slightly.

In certain embodiments, the controller 162 may reduce a stage of a valve of a previously adjusted heating module when an additional heating module is activated. For example, if the first heating module 182 is the currently active heating module of the furnace system 102, the second valve 202 is in the second stage position, and the modulating valve 198 reaches the terminal position, such as a full capacity position, after one or more iterations through the steps 278, 280, 282, the controller 162 may, in a subsequent iteration of the process 270, at the step 284, instruct the third valve 244 of the second heating module 184 to open to the first stage position, instruct the modulating valve 198 to transition to a particular staging flow position, and instruct the second valve 202 to return to the first stage position. In addition, the controller 162 may initiate operation of the burner assemblies 242 associated with the second heating module 184 and may instruct the third draft inducer blower 252 to activate and operate at the first stage speed. Accordingly, the controller 162 may ensure that an overall heat output rate of the furnace system 102 remains substantially constant when the second heating module 184 is activated alongside the first heating module 182. The controller 162 may again iterate through the steps 278, 280, and 282 to incrementally open the modulating valve 198 and gradually increase an amount of the working fluid 216 generated by the first set of burner assemblies 212. When the modulating valve 198 again reaches the terminal position or full capacity position, the controller 162 may instruct the second valve 202 to return to the second stage position. The controller 162 may subsequently iterate though the steps of the process 270 in accordance with the techniques discussed above to sequentially activate additional heating modules of the furnace system 102.

In some embodiments, if, during any iteration of the process 270, the difference between the measured temperature of the supply air 144 and the target temperature setpoint of the supply air 144 is equal to or less than the threshold amount at the step 278, the controller 162 may switch to operate the modulating valve 198, the first draft inducer blower 230, and/or other furnace components 152 in accordance with a second rate-of-change control scheme, as indicated by step 286 and step 288. When operating the modulating valve 198 and the first draft inducer blower 230 in accordance with the second rate-of-change control scheme, the controller 162 may repeatedly adjust or update a position of the modulating valve 198 and adjust or update a speed of the first draft inducer blower 230 after lapse of a second time interval, which may be less than the first time interval, between sequential iterations of the process 270. For example, in some embodiments, the second time interval may be 90 seconds, 120 seconds, 180 seconds, or more than 180 seconds. In this manner, by operating the furnace system 102 in accordance with the second rate-of-change control scheme, the controller 162 may increase a time delay between consecutive iterations of the process 270 and, thus, decrease a rate at which a heat output rate of the first, second, and/or third heating modules 182, 184, 186 is increased. In other words, the controller 162 may ensure that, as an actual temperature of the supply air 144 approaches the target temperature of the supply air 144, the heat output rates of the first, second, and/or third heating modules 182, 184, 186 are increased more slowly, as compared to a rate at which the heat output rates of the first, second, and/or third heating modules 182, 184, 186 are increased when the difference between the measured temperature of the supply air 144 and the target temperature setpoint of the supply air 144 exceeds the threshold amount. Accordingly, the controller 162 may mitigate or substantially eliminate a likelihood of overheating the supply air 144 via the first, second, and/or third heating modules 182, 184, 186 when a temperature of the supply air 144 is near the target temperature setpoint.

In some embodiments, if the modulating valve 198 reaches the terminal position after execution of the step 288, the controller 162 may activate an additional burner assembly and a corresponding draft inducer blower of the furnace system 102 or increase a stage of a previously activated burner assembly and increase a speed stage of a corresponding draft inducer blower, as indicated by the step 284, in accordance with the techniques discussed above. Additionally, at the step 284, the controller 162 may instruct the modulating valve 198 to transition to a staging flow position and may instruct the first draft inducer blower 230 to operate at a corresponding staging speed. When operating the furnace system 102 in accordance with the second rate-of-change control scheme, the controller 162 may, during each iteration of the process 270, after the step 284 or after the step 288, evaluate whether a call for heating exists, as indicated by the step 285. For example, to determine whether operation of the furnace system 102 is desired, the controller 162 may evaluate, via feedback from the temperature sensor 174, whether the temperature of the supply air 144 is within a target range, such as within 1 degree Fahrenheit, of the target temperature setpoint. If the temperature of the supply air 144 is not within the target range of the target temperature setpoint, the controller 162 may continue to iterate through the steps of the process 270 in accordance with the techniques discussed above. Additionally or alternatively, the controller 162 may determine that a call for heating exists when the control device 16, the temperature sensors 158, and/or other suitable thermostats within the building 10 provide feedback indicating that a temperature within one or more rooms or zones of the building 10 is below the target temperature setpoint by a particular threshold amount.

If the controller 162 determines that no call for heating exists, the controller 162 continues normal operation of the HVAC system 100, as indicated by the step 274. During normal operation or non-heating operation of the HVAC system 100, the controller 162 does not activate the furnace system 102. Indeed, in some embodiments, at the step 274, the controller 162 may suspend operation of the furnace system 102 by closing the valves 198, 202, 244, and/or 248 and deactivating the draft inducer blowers 230, 232, 252, and/or 254 when the temperature of the supply air 144 is within the target range of the target temperature setpoint for a predetermined time interval, such as, for example, 60 seconds. In other embodiments, the controller 162 may suspend operation of the furnace system 102 when the temperature of the supply air 144 meets or exceeds the target temperature setpoint.

In some embodiments, during any iteration of the process 270, the controller 162 may, at the step 282 and/or the step 288, decrease a fuel flow rate through the modulating valve 198 and reduce an operational speed of the first draft inducer blower 230 in response to a determination that a demand for heated air supplied by the furnace system 102 is reduced. For example, the controller 162 may determine that a demand for heated air, such as the heated supply air 144, is reduced based on feedback from one or more thermostats within the thermal load 110, such the temperature sensors 158. For example, the controller 162 may determine that the heating demand for the furnace system 102 is decreased upon receiving feedback that a user, such as an occupant within the thermal load 110, reduces a target temperature setpoint within one or more rooms or zones of the thermal load 110 via corresponding thermostats within these rooms or zones. Additionally or alternatively, the controller 162 may determine that a heating demand for the furnace system 102 is reduced based on a rate of change of a temperature of the supply air 144.

For example, if a temperature of the supply air 144 increases at a rate that exceeds a threshold rate, such as may occur when a flow rate of the mixed air 128 supplied to the furnace system 102 is relatively low, the controller 162 may determine that the heating demand for the furnace system 102 is low, and thus, decrease a fuel flow rate through the modulating valve 198 and reduce an operational speed of the first draft inducer blower 230. In some embodiments, if the modulating valve 198 is closed to a particular position, such as, for example, the idle flow position, the controller 162 may reduce a heating stage of a previously activated heating module or deactivate a previously activated heating module. As a non-limiting example, if the controller 162 determines that a heating demand for the furnace system 102 decreases, the first heating module 182 and the second heating module 184 are active, and the modulating valve 198 is closed to the idle flow position or to another position during a particular iteration of the process 270, the controller 162 may, at a subsequent iteration of the process 270, reduce a stage of the third valve 244 or transition the third valve 244 to a closed position.

It should be appreciated that the first rate-of-change control scheme and the second rate-of-change control scheme may also define other control aspects of the process 270 in addition to, or in lieu of, the control aspects discussed above. Indeed, in some embodiments, the first rate-of-change control scheme and the second rate-of-change control scheme may determine a quantity of adjustment increments by which the controller 162 adjusts modulating valve 198 and the first draft inducer blower 230 during a particular iteration of the process 270. For example, when operating in accordance with the first rate-of-change control scheme, the controller 162 may, at the step 282, adjust or update a position of the modulating valve 198 by a first magnitude of adjustment increment during each iteration of the process 270. The controller 162 may, when operating in accordance with the second rate-of-change control scheme, adjust or update the position of the modulating valve 198 by a second magnitude of adjustment increment at the step 288 during each iteration of the process 270. In some embodiments, the first magnitude of adjustment increment may be greater than, such as double, triple, or quadruple, the second magnitude of adjustment increment. Accordingly, when operating the modulating valve 198 in accordance with the first rate-of-change control scheme, the controller 162 may open the modulating valve 198 by a relatively large amount, such as by, for example, 20 percent of a fully open position of the modulating valve 198, during each iteration of the process 270. When operating modulating valve 198 in accordance with the second rate-of-change control scheme, the controller 162 may open the modulating valve 198 by a relatively small amount, such as by, for example, five percent of a fully open position of the modulating valve 198, during each iteration of the process 270.

In some embodiments, the controller 162 may, during each iteration of the process 270, at the step 282 and at the step 288, increase a speed of the first draft inducer blower 230 proportionally to a magnitude of adjustment increment by which the modulating valve 198 is opened at the steps 282, 288. For example, the controller 162 may increase a speed of the first draft inducer blower 230 by a first increment magnitude at the step 282 when the modulating valve 198 is operated in accordance with the first rate-of-change control scheme. The controller 162 may increase a speed of the first draft inducer blower 230 by a second increment magnitude, which may be less than the first increment magnitude, at the step 288, when the modulating valve 198 is operated in accordance with the second rate-of-change control scheme. Accordingly, the controller 162 may fine-tune the operational speed of the first draft inducer blower 230 based on an updated position of the modulating valve 198 or, in other words, based on the current amount of working fluid 216 generated by the first set of burner assemblies 212.

In this manner, the controller 162 may, in accordance with the techniques discussed above, increase a heat output rate of the first, second, and/or third heating modules 182, 184, 186 relatively quickly when the operating the modulating valve 198 in accordance with the first rate-of-change control scheme, such as when a temperature difference between the supply air 144 and the target temperature setpoint of the supply air 144 is relatively large. By operating the modulating valve 198 in accordance with the second rate-of-change control scheme when the temperature difference between the supply air 144 and the target temperature setpoint of the supply air 144 is relatively small, the controller 162 may ensure that the heat output rates of the first, second, and/or third heating modules 182, 184, 186 are increased more slowly. As such, the controller 162 may mitigate or substantially eliminate a likelihood of overheating the supply air 144 via the first, second, and/or third heating modules 182, 184, 186, and may deactivate the first, second, and/or third heating modules 182, 184, 186 when the supply air 144 temperature is equal to or exceeds the target temperature setpoint.

In some embodiments, instead of adjusting a position of the modulating valve 198 after lapse of the first time interval at the step 282 when operating the modulating valve 198 in accordance with the first rate-of-change control scheme and adjusting the position of the modulating valve 198 after lapse of the second time interval at the step 288 when operating the modulating valve 198 in accordance with the second rate-of-change control scheme, the controller 162 may adjust the position of the modulating valve 198 at the step 282 or the step 288 after lapse of a common time interval, such as 60 seconds, regardless of whether the controller 162 is operating the modulating valve 198 in accordance with the first rate-of-change control scheme or in accordance with the second rate-of-change control scheme. For example, when operating the modulating valve 198 in accordance with the first rate-of-change control scheme, the controller 162 may, at the step 282, adjust the position of the modulating valve 198 by the first magnitude of adjustment after lapse of the common time interval. The controller 162 may, when operating in accordance with the second rate-of-change control scheme, adjust the position of the modulating valve 198 by a second magnitude of adjustment at the step 288 after lapse of the common time interval. It should be appreciated that, in certain embodiments, the first rate-of-change control scheme and the second rate-of-change control scheme may determine both the time interval between sequential iterations of process 270, as well as the magnitude of adjustment increment by which the modulating valve 198 is opened and by which the operational speed of the first draft inducer blower 230 is adjusted during each iteration of the process 270.

In some embodiments, the HVAC system 100 may be configured to operate in a ventilation mode in which parameters of the supply air 144 supplied to the rooms or zones of the building 10 are controlled based on feedback from the one or more auxiliary sensors 160, such as one or more carbon dioxide sensors positioned within the building 10. For example, in the ventilation mode, the controller 162 may be configured to increase a flow rate of the exhaust air 132 discharging into the atmosphere via the exhaust air outlet 134, as well as increase a flow rate of the outdoor air 136 that is drawn into the enclosure 112 to form the mixed air 138 when a carbon dioxide level within the rooms or zones rises above a target value by a threshold amount. Accordingly, the controller 162 may decrease a concentration of carbon dioxide in the mixed air 138 and, therefore, decrease the concentration of carbon dioxide in the supply air 144. Conversely, the controller 162 may be configured to decrease a flow rate of the exhaust air 132 discharging into the atmosphere and to decrease a flow rate of the outdoor air 136 that is drawn into the enclosure 112 when a carbon dioxide level within the rooms or zones falls below the target value for the carbon dioxide level.

In some embodiments the controller 162 may be configured to activate the first set of burner assemblies 212 and to adjust the modulating valve 198 in accordance with the techniques discussed above to maintain a temperature of the supply air 144 substantially similar to a temperature of the return air 128 discharging from the rooms or zones of the building 10. That is, the controller 167 may enable the furnace system 102 to provide "neutral air" to the building 10, where the neutral air has a temperature that is substantially similar to a temperature of the return air 128 discharging from the building 10.

For example, the controller 162 may be configured to adjust a heat output rate of the furnace system 102 to ensure that a temperature of the supply air 144, as measured by the temperature sensor 174, is substantially similar as a temperature of the return air 128, as measured by the temperature sensors 158 and/or one or more temperature sensors positioned within the exhaust duct 124, discharging from the rooms or zones of the building 10. Accordingly, the controller 162 may reduce a carbon dioxide concentration within the building 10 without heating or cooling the rooms or zones of the building 10. In some embodiments, the controller 162 may be configured to select a rate-of-change control scheme by which to operate the furnace system 102 when in the ventilation mode based on a differential between the temperature measurement acquired by the temperature sensor 174 and one or more of the temperature measurements acquired by the temperature sensors 158. For example, the controller 162 may be configured to operate the furnace system 102 in accordance with the first rate-of-change control scheme when a differential between the temperature measurement acquired by the temperature sensor 174 and one or the temperature measurements acquired by the temperature sensors 158 exceeds a threshold amount. The controller 162 may be configured to operate the furnace system 102 in accordance with the second rate-of-change control scheme when a differential between the temperature measurement acquired by the temperature sensor 174 and one of the temperature measurements acquired by the temperature sensors 158 is equal to or less than the threshold amount.

As set forth above, embodiments of the present disclosure may provide one or more technical effects useful for regulating a heat output rate of the furnace system 102. In particular, the controller 162 is configured to adjust the valves 198, 202, 244, and/or 248 to regulate combustion product production of the burner assemblies 188, 242 based on a temperature differential between the supply air 144 and a target temperature setpoint of the supply air 144. Accordingly, the controller 162 may reduce or substantially eliminate occurrence of temperature fluctuations of the supply air 144 that may occur when the blower 130 modulates a flow rate of the mixed air 138 traveling across the heating modules 182, 184, 186. In this manner, the controller 162 facilitates discharge of the supply air 144 at a temperature that is substantially close to the target temperature setpoint of the supply air 144 during operation of the HVAC system 100. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace of a heating, ventilation, and/or air conditioning (HVAC) system, comprising:

a heat exchange tube configured to receive a working fluid from a burner;

a modulating valve fluidly coupled to the burner and configured to regulate an amount of fuel supplied to the burner to generate the working fluid;

a blower configured to draw the working fluid through the heat exchange tube;

a motor drive configured to adjust a speed of the blower; and a controller configured to incrementally adjust a position of the modulating valve and control the motor drive to incrementally adjust the speed of the blower during execution of a first rate-of-change control scheme to increase a heat output of the furnace at a first rate based on a difference between a temperature of air discharged from the HVAC system and a temperature setpoint being greater than a threshold amount, and to incrementally adjust the position of the modulating valve and control the motor drive to incrementally adjust the speed of the blower during execution of a second rate-of-change control scheme to increase the heat output of the furnace at a second rate based on the difference between the temperature of the air discharged from the HVAC system and the temperature setpoint being equal to or less than the threshold amount.

2. The furnace of claim 1, wherein the first rate-of-change control scheme includes incrementally adjusting the position of the modulating valve and incrementally adjusting the speed of the blower based on a first time interval, and the second rate-of-change control scheme includes incrementally adjusting the position of the modulating valve and incrementally adjusting the speed of the blower based on a second time interval that is greater than the first time interval.

3. The furnace of claim 1, wherein the heat exchange tube is one of a plurality of heat exchange tubes configured to receive the working fluid from the burner.

4. The furnace of claim 3, wherein the burner comprises a system of assembled burners.

5. The furnace of claim 3, wherein the furnace includes an additional plurality of heat exchange tubes configured to receive an additional working fluid and an additional blower fluidly coupled to the additional plurality of heat exchange tubes to draw the additional working fluid through the additional plurality of heat exchange tubes.

6. The furnace of claim 5, comprising a two-stage valve fluidly coupled to the additional plurality of heat exchange tubes and configured to regulate an additional amount of fuel supplied to generate the additional working fluid.

7. The furnace of claim 5, wherein the additional blower is a two-stage blower.

8. The furnace of claim 1, wherein the modulating valve is configured to modulate between more than three positions.

9. The furnace of claim 1, wherein the HVAC system is a rooftop unit.

10. The furnace of claim 1, wherein the controller is a controller system including a first automation controller configured to control the modulating valve and a second automation controller configured to control the motor drive.

11. A furnace of a heating, ventilation, and/or air conditioning (HVAC) system, comprising:

a heat exchange tube configured to receive a working fluid from a burner;

a modulating valve fluidly coupled to the burner and configured to regulate an amount of fuel supplied to the burner to generate the working fluid;

a blower configured to draw the working fluid through the heat exchange tube;

a motor drive configured to adjust a speed of the blower; and a controller configured to adjust a position of the modulating valve and control the motor drive to adjust the speed of the blower with a first rate-of-change control scheme and with a second rate-of-change control scheme based on a measured parameter of air discharged from the HVAC system, wherein, during execution of the first rate-of-change control scheme, the controller is configured to incrementally adjust the position of the modulating valve and operate the motor drive to incrementally adjust the speed of the blower upon lapse of a first time interval, and, during execution of the second rate-of-change control scheme, the controller is configured to incrementally adjust the position of the modulating valve and operate the motor drive to incrementally adjust the speed of the blower upon lapse of a second time interval different than the first time interval.

12. The furnace of claim 11, wherein the controller is configured to incrementally adjust the position of the modulating valve and configured to control the motor drive to incrementally adjust the speed of the blower using the first rate-of-change control scheme based on a difference between the measured parameter of the air discharged from the HVAC system and a target setpoint being greater than a threshold amount, and wherein the controller is configured to incrementally adjust the position of the modulating valve and configured to control the motor drive to incrementally adjust the speed of the blower using the second rate-of-change control scheme based on the difference between the measured parameter of the air discharged from the HVAC system and the target setpoint being equal to or less than the threshold amount.

13. The furnace of claim 11, wherein, during execution of the first rate-of-change control scheme, the controller is configured to incrementally adjust the position of the modulating valve and operate the motor drive to incrementally adjust the speed of the blower with adjustment increments having a first magnitude upon lapse of the first time interval, and, during execution of the second rate-of-change control scheme, the controller is configured to incrementally adjust the position of the modulating valve and operate the motor drive to incrementally adjust the speed of the blower with adjustment increments having a second magnitude upon lapse of the second time interval.

14. The furnace of claim 13, wherein the first magnitude is greater than the second magnitude.

15. The furnace of claim 14, wherein the first time interval is less than the second time interval.

16. The furnace of claim 11, comprising:

an additional heat exchange tube configured to receive an additional working fluid from an additional burner;

a two-stage blower configured to draw the additional working fluid through the additional heat exchange tube; and a two-stage valve fluidly coupled to the additional heat exchange tube and configured to regulate an additional amount of fuel supplied to the additional burner to generate the additional working fluid.

17. The furnace of claim 16, wherein the controller is configured to adjust a stage of the two-stage valve and an operational speed stage of the two-stage blower based on a determination that the modulating valve is in a fully open position.

18. The furnace of claim 11, wherein the measured parameter of the air discharged from the HVAC system is a temperature of the air discharged from the HVAC system.

19. A furnace of a heating, ventilation, and/or air conditioning (HVAC) system, comprising:

a modulating valve configured to control a fuel flow to a burner configured to combust the fuel flow to generate a working fluid and discharge the working fluid into a heat exchange tube;

a blower configured to draw the working fluid through the heat exchange tube;

a motor drive configured to adjust a speed of the blower; and a controller configured to adjust the modulating valve and control the motor drive to adjust the speed of the blower with a first rate-of-change control scheme and with a second rate-of-change control scheme based on a measured parameter of air discharged from the HVAC system, wherein, during execution of the first rate-of-change control scheme, the controller is configured to incrementally adjust a position of the modulating valve and operate the motor drive to incrementally adjust the speed of the blower with adjustment increments having a first magnitude, and, during execution of the second rate-of-change control scheme, the controller is configured to incrementally adjust the position of the modulating valve and operate the motor drive to incrementally adjust the speed of the blower with adjustment increments having a second magnitude different than the first magnitude.

20. The furnace of claim 19, comprising:

a two-stage valve configured to control an additional fuel flow to an additional burner, wherein the additional burner is configured to combust the additional fuel flow to discharge an additional working fluid into an additional heat exchange tube positioned to receive the additional working fluid; and a two-stage blower configured to draw the additional working fluid through the additional heat exchange tube.

21. The furnace of claim 20, wherein the controller is configured to adjust a stage of the two-stage valve and to adjust a speed stage of the two-stage blower based on a determination that the modulating valve is in a fully open position.

22. The furnace of claim 19, wherein the measured parameter of the air discharged from the HVAC system is a temperature of the air discharged from the HVAC system measured by a temperature sensor positioned in a supply duct of the HVAC system.

23. The furnace of claim 22, wherein the controller is configured to select the first rate-of-change control scheme based on a determination that a differential between the temperature of the air discharged from the HVAC system and a conditioned space temperature exceeds a threshold amount, and wherein the controller is configured to select the second rate-of-change control scheme based on a determination that the differential between the temperature of the air discharged from the HVAC system and the conditioned space temperature is less than the threshold amount.

24. The furnace of claim 23, wherein, during execution of the first rate-of-change control scheme, the controller is configured to incrementally open the modulating valve and operate the motor drive to incrementally increase the speed of the blower upon lapse of a first time interval, and, during execution of the second rate-of-change control scheme, the controller is configured to incrementally open the modulating valve and operate the motor drive to incrementally increase the speed of the blower upon lapse of a second time interval, wherein the first time interval is less than the second time interval.

25. The furnace of claim 19, wherein the controller is configured to adjust the speed of the blower to maintain an efficiency of the blower at approximately 81 percent.

26. The furnace of claim 19, wherein the motor drive is a variable frequency drive.

27. The furnace of claim 1, wherein the first rate of the increase of the heat output of the furnace is greater than the second rate of the increase of the heat output of the furnace.

* * * * *